US006457658B2

(12) United States Patent
Srinath et al.

(10) Patent No.: US 6,457,658 B2
(45) Date of Patent: Oct. 1, 2002

(54) TWO-LEVEL NOZZLES WITH INTEGRATED OR BUILT-IN FILTERS AND METHOD

(75) Inventors: Dharapuram N. Srinath, Ellicott City; Eric Koehler, Woodstock, both of MD (US)

(73) Assignee: Bowles Fluidics Corporation, Columbia, MD (US)

( * ) Notice: Subject to any disclaimer, the term of this patent is extended or adjusted under 35 U.S.C. 154(b) by 0 days.

(21) Appl. No.: 09/754,075

(22) Filed: Jan. 5, 2001

Related U.S. Application Data

(63) Continuation-in-part of application No. 09/457,316, filed on Dec. 9, 1999, now Pat. No. 6,186,409.

(60) Provisional application No. 60/111,745, filed on Dec. 10, 1998.

(51) Int. Cl.[7] ..... B05B 1/08

(52) U.S. Cl. ..... 239/589.1; 239/101; 239/462; 239/590; 239/600; 239/DIG. 3; 137/833; 137/835

(58) Field of Search ..... 239/101, 102.1, 239/462, 575, 590, 590.5, 600, DIG. 3, 589.1; 137/809–813, 826, 833, 835, 827

(56) References Cited

U.S. PATENT DOCUMENTS

| | | | | | |
|---|---|---|---|---|---|
| 3,557,814 | A | * | 1/1971 | Neradka | 137/835 |
| 4,151,955 | A | | 5/1979 | Stouffer | 239/11 |
| 4,662,568 | A | | 5/1987 | Bauer | 239/589.1 |
| 4,955,547 | A | | 9/1990 | Woods | 239/589.1 |
| 5,213,270 | A | | 5/1993 | Stouffer et al. | 239/589.1 |
| 5,472,143 | A | | 12/1995 | Bartels et al. | 239/462 |
| 5,524,660 | A | * | 6/1996 | Dugan | 137/833 |

* cited by examiner

*Primary Examiner*—Steven J. Ganey
(74) *Attorney, Agent, or Firm*—Jim Zegeer

(57) ABSTRACT

A molded fluid device having a power nozzle with a width W and a coupling passage coupling a source of fluid to the power nozzle. The coupling passage is formed on one chip or insert surface and has a planar enlargement and a plurality of posts spaced across the enlargement, the spacing S between each post being less than the width of the power nozzle with the sum of spacing S being greater than the width W. A liquid spray nozzle is formed on an opposing chip surface and connected to the coupling passage downstream of the posts.

5 Claims, 8 Drawing Sheets

TWO-LEVEL NOZZLES WITH INTEGRATED OR BUILT-IN FILTERS AND METHOD

REFERENCE TO RELATED APPLICATION

This application is a continuation-in application of Ser. No. 09/457,316 filed Dec. 9, 1999, now U.S. Pat. No. 6,186,409 and entitled NOZZLES WITH INTEGRATED OR BUILT-IN FILTERS AND METHOD which in turn is the subject of provisional application Ser. No. 60/111,745 filed Dec. 10, 1998 and entitled FLUID NOZZLES WITH INTEGRATED OR BUILT-IN FILTERS.

BACKGROUND AND BRIEF DESCRIPTION OF THE INVENTION

Fluid oscillators as shown in FIG. 1 are well known and particularly useful in liquid spray applications such as washer nozzles. Such fluid oscillators are typically manufactured of molded plastic and comprise a fluid oscillator circuit OC or silhouette molded in one surface of a chip or insert 13 and a housing 10 having a cavity 11 into which the chip or insert 13 is forcibly inserted. A source of fluid under pressure is supplied to the power nozzle PN in the fluid oscillator circuit OC by way of an inlet pipe or barb 12. Care is taken in the design to assure a seal between the housing internal surfaces and the mating surfaces of the chip or insert. In mass manufacturing of such chips and housing, small loose plastic particles can be carried by liquid flow and can clog portions of the fluid circuit or outlet thereby blocking the flow of liquid (washer liquid in the case of a washer nozzle). In the case of fluid oscillators, this interrupts the oscillation function.

There have been efforts to place screens or discrete filter screens upstream of the fluid circuit, but these expedients add cost and complexity to the device. The problem solved and addressed by the present invention is potential clogging of liquid flow devices.

The present invention solves this problem by integrally providing on one side of the chip liquid flow paths with extra places or enlargements and spaced posts for contaminants or loose particles to lodge or become trapped in areas other than main flow areas so that there are additional flow passages or ways for liquid to flow if a contaminant or particle blocks one or more passages or spaces between posts. The functional fluid circuit is formed on the opposing side of the chip with a liquid flow path between chip sides.

The invention provides for low profiles in areas specifically designed to encourage contaminants to flow into and stop in areas other than the power nozzle or the main jet flow area. By providing integral molded enlargements with spaced posts in areas as described above, the fluid nozzle can continue to function in spite of partial upstream blockage in the enlargement area because a power jet channel is still completely open. In the absence of the present invention, contaminants usually flow directly into the power nozzle or the main jet area, thereby making the system nonfunctional.

The invention features a molded fluid device having a power nozzle with a width W and a coupling passage coupling a source of fluid to said power nozzle. The coupling passage is molded on one chip or insert side and has an enlargement and a plurality of posts spaced across the enlargement, the spacing S between each post being less than the width of the power nozzle with the sum of spacings S being greater than the width W and the coupling passage and posts being integrally molded with the fluid device. The dimensions of the coupling passage, the planar enlargement and the spacing S are such that the fluid flow rate from the source to the power nozzle is substantially unaffected when a foreign particle blocks any of the spaces between the posts. In a preferred embodiment, the fluid circuit is a liquid oscillator which issues a fan spray of liquid droplets to ambient and wherein the dimensions of the planar enlargement and the spaces S are such that the fan spray is substantially unaffected when one or more foreign particles is trapped in any one or more of the spaces. The coupling passage and the posts are molded as an integral molding or chip with the fluid device. A housing member into which the integral chip molding is inserted has a coupling to a source of liquid under pressure.

The invention has advantageous usage in molded liquid-spray nozzles, particularly when the liquid is sprayed to ambient; and still more particularly when the liquid is a wash liquid to be sprayed on a surface to be washed, such as vehicle glass or on a flow surface.

Benefits of the present invention include the following:

1. Provides for prolonged life for the system in which the nozzle is used.
2. Provides a filter mechanism free of cost compared to in-line filters which require a separate component and some of which require a hose to be cut to include the filter, install the filter, etc.
3. Permits a shorter housing member.

DESCRIPTION OF THE DRAWINGS

The above and other objects, advantages and features of the invention will become more apparent when considered with the following specification and accompanying drawings, wherein.

DETAILED DESCRIPTION OF THE INVENTION

Figure 2A:
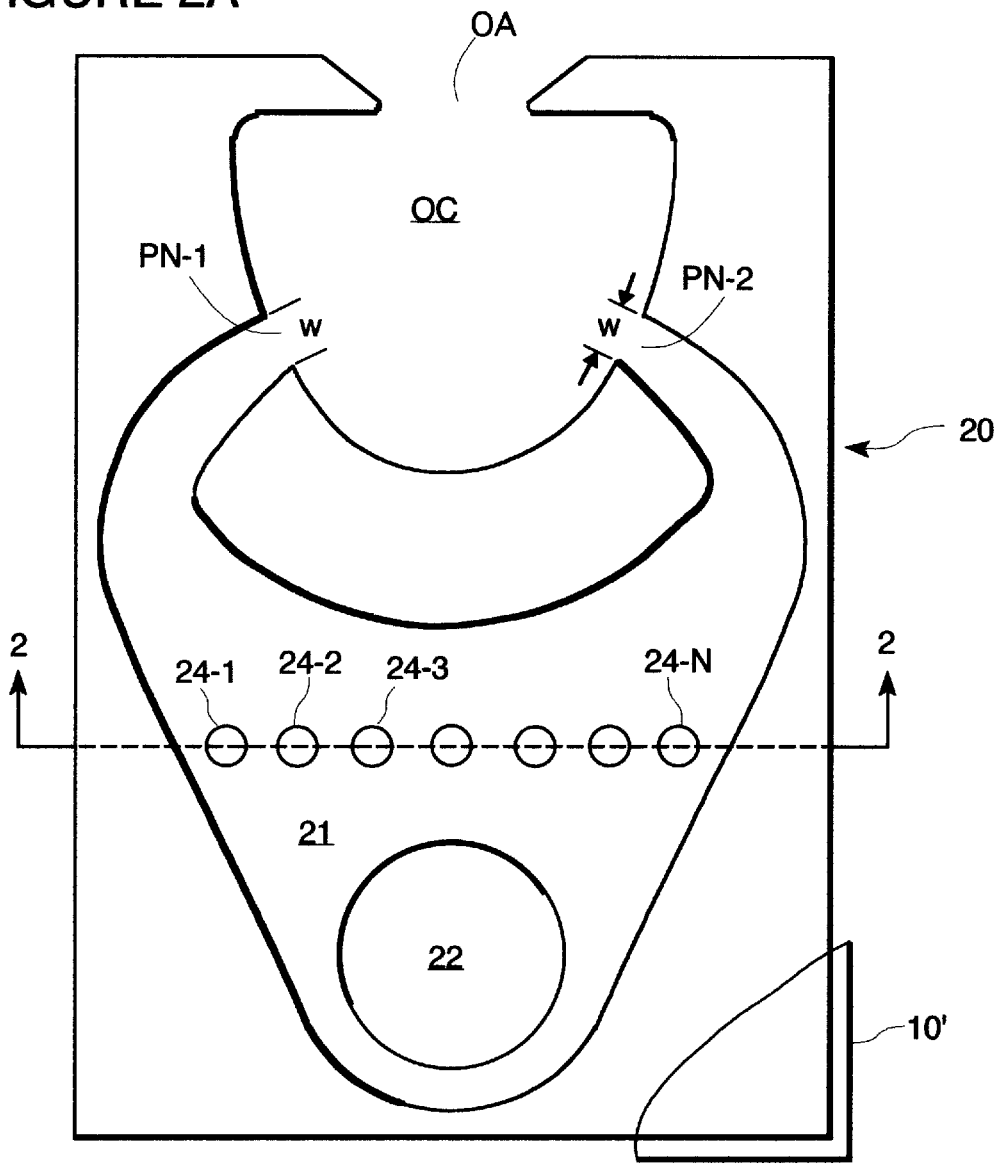
FIG. 2A is an illustration of a preferred embodiment of a fluid oscillator incorporating the invention.
Figure 2B:
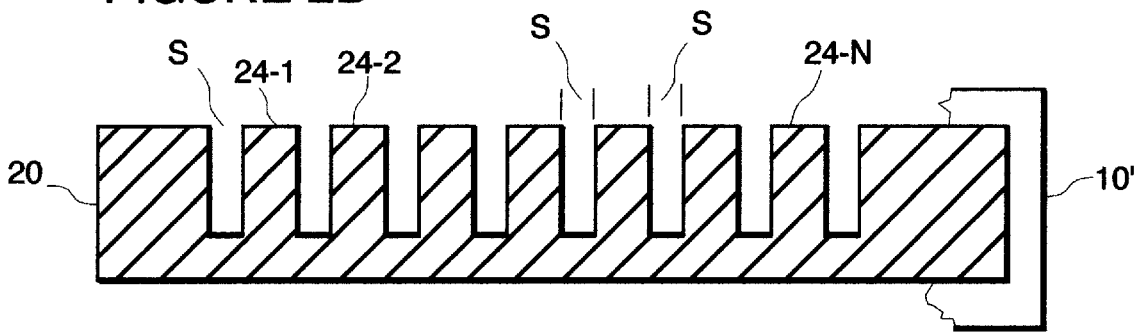
FIG. 2B is a section taken on lines 2—2 thereof.

Referring now to FIGS. 2A and 2B, the fluid circuit is of a multiple power nozzle type oscillator 20 in which a pair of power nozzles PN-1 and PN-2 issue jets of fluid (preferably liquid) into an oscillation chamber OC in which a system of oscillating vortices is set up which issues a sweeping jet through an outlet aperture OA to ambient where the liquid jet breaks up into droplets. The fluid feed for the power nozzles PN-1, PN-2 is constituted by a planar passage 21 from a source of fluid 22. It will be noted that the passage 21 is a planar enlargement in the flow of fluid to the power nozzles PN-1 and PN-2. A portion of housing 10 is illustrated. (Various other embodiments of the fluid oscillator element is disclosed in copending application Ser. No. 09/417,899 filed Oct. 14, 1999 and entitled FEEDBACK-FREE FLUID OSCILLATOR AND METHOD.)

Integrally molded with the body of the circuit elements are a plurality of posts or pillars 24-1, 24-2 . . . 24-N. The power nozzles PN-1, PN-2 each have a width W and the spacing S between the pillars or posts 24-1, 24-2 . . . 24-N need not be equal but preferably are equal and the spacing S between each post 24 is less than the width W of the power nozzle with the sum of the spacings S being greater than the width of the power nozzle W.

Figure 3A:
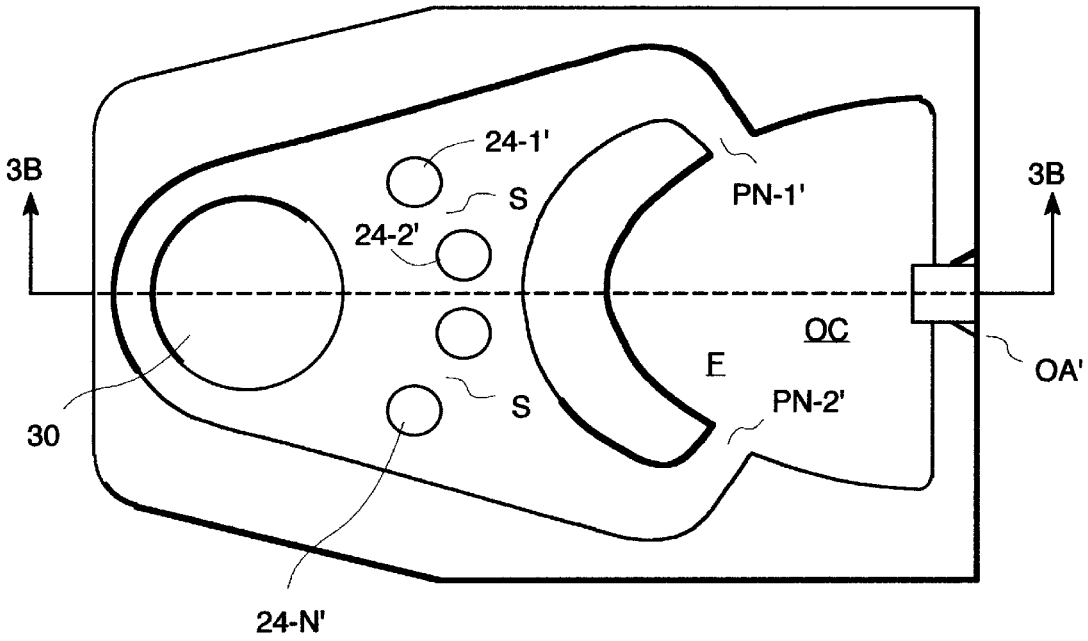
FIG. 3A is an illustration of a further embodiment of the invention.
Figure 3B:
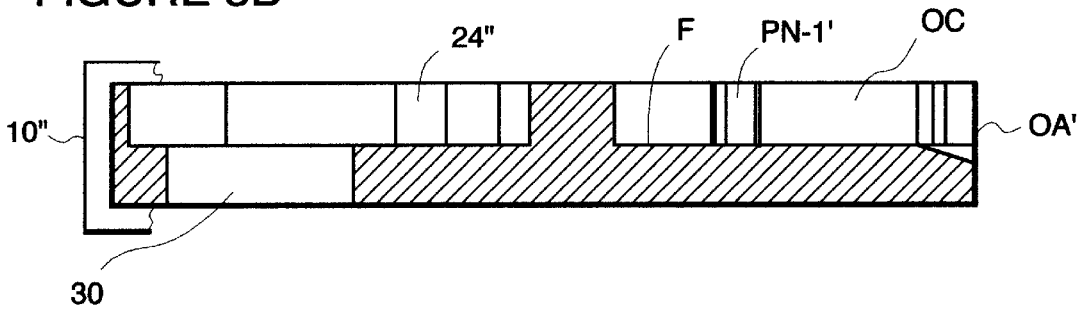
FIG. 3B is a sectional view taken on lines 3—3 thereof.

The embodiment shown in FIGS. 3A and 3B is essentially the same as the embodiment in FIG. 2 except that here the posts or pillars 24' are in an arc. In this embodiment, the floor F of the fluid oscillator is flat up to the outlet OA throat where there is a downward taper as shown in the sectional view (FIG. 3B). In this embodiment, the fluid flow is from the bottom of the element through aperture 30 as indicated in FIG. 3B, but it could be from the top. A portion of the housing is shown in FIG. 3B.

Figure 4:
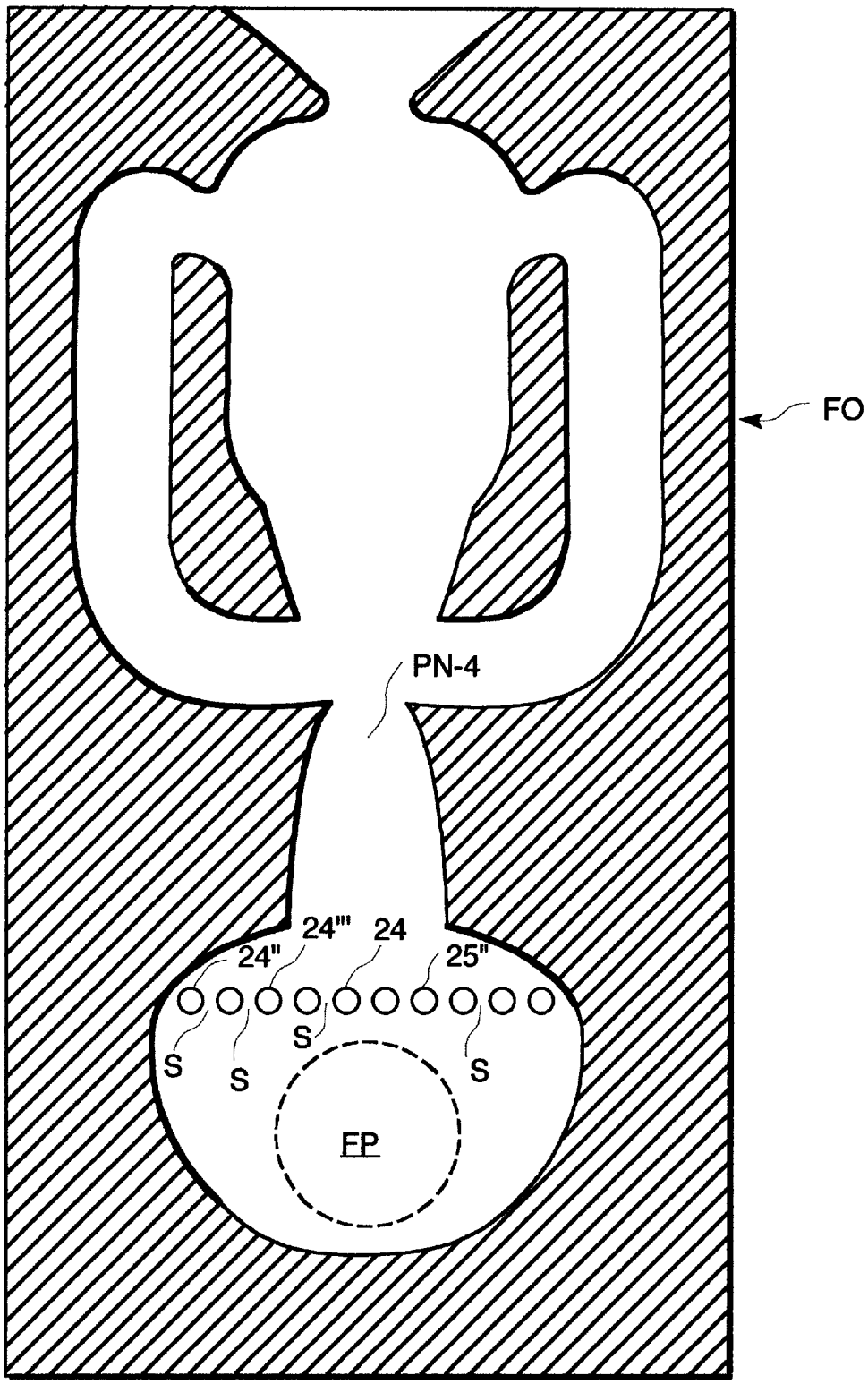
FIG. 4 is a drawing illustrating a built-in filter concept of the present invention as applied to a further type of fluid oscillator.

In the embodiment shown in FIG. 4, a different fluid oscillator OF is illustrated (this fluid oscillator being of the type shown in Bray U.S. Pat. Nos. 4,463,904 issued Aug. 7, 1984 and 4,645,126 issued Feb. 24, 1987, incorporated by reference and having the cold performance feature thereof). Note that in this embodiment, the pillars or posts 24' are in a row, and the fluid feed FF is in advance of or upstream of that row of pillars or posts 24'.

Figure 5:
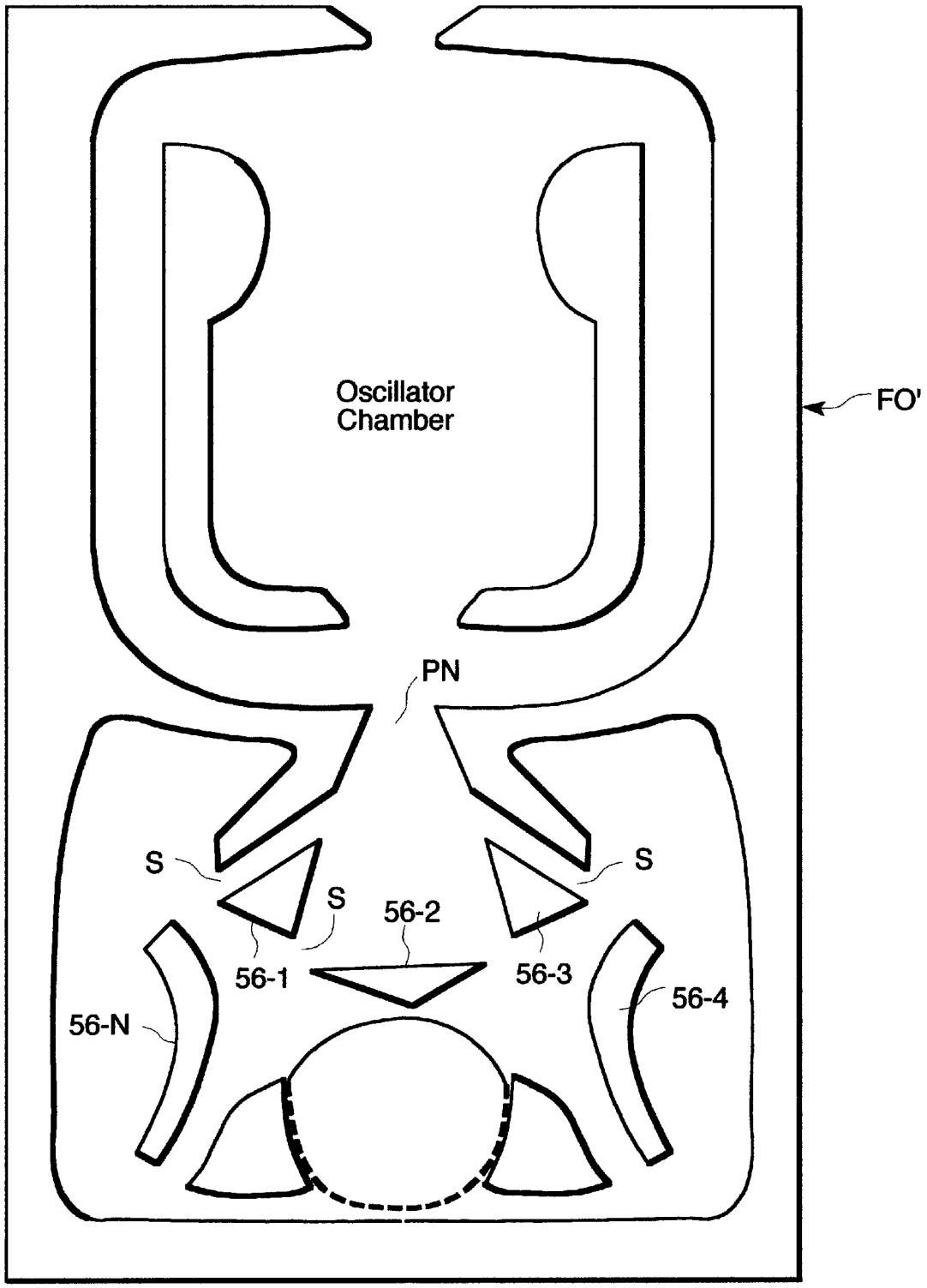
FIG. 5 is a further fluid oscillator having a power nozzle incorporating the present invention, FIGS. 6A and 6B disclosure a circuit diagram of a further fluid oscillator incorporating the invention; in this case, the two levels, FIG. 6B illustrating the flow to the power nozzle and FIG. 6A illustrating the fluid oscillator itself with the input power nozzle flow and built-in filter illustrated in dotted lines in FIG. B.

In the embodiment shown in FIG. 5, the pillars 56-1, 56-2 . . . 56-N or posts need not be circular, round or square; they can be of various shapes. In this embodiment, the fluid oscillator OF' is of the type disclosed in Stouffer U.S. Pat. No. 4,508,267 issued Apr. 2, 1985, incorporated herein by reference. In each case, the various multiple passages between power nozzle or input for feed for liquid has a spacing S and the embodiment shown in FIG. 5, the spacings can be varied. All of the spacings S between the posts are less than the width W of the power nozzle with the sum of the spacings being greater than W so that the fluid flow from the source to the power nozzle is substantially unaffected if a foreign particle blocks any one or more of the spaces S between the posts.

THE PRESENT INVENTION

The present invention provides a liquid spray device comprising a two-sided fluid circuit chip or insert and a housing member having a chamber for sealingly receiving the fluid circuit chip and an input port for coupling the chamber to a source of liquid under pressure. The chip has first and second sides and an output end which is transverse to the first and second sides. The first side including a subchamber having upstream and downstream ends and a series of spaced posts forming a filter dividing the upstream end of the subchamber from the downstream end of the subchamber with the upstream end being in registry with the input port to receive liquid from a source of liquid. The second side including a fluid circuit formed therein, with the fluid circuit having a power nozzle, there being a liquid flow path from the downstream end of said subchamber to the power nozzle, said fluid circuit having an outlet throat and an outlet to ambient in the output end.

Figure 6A:
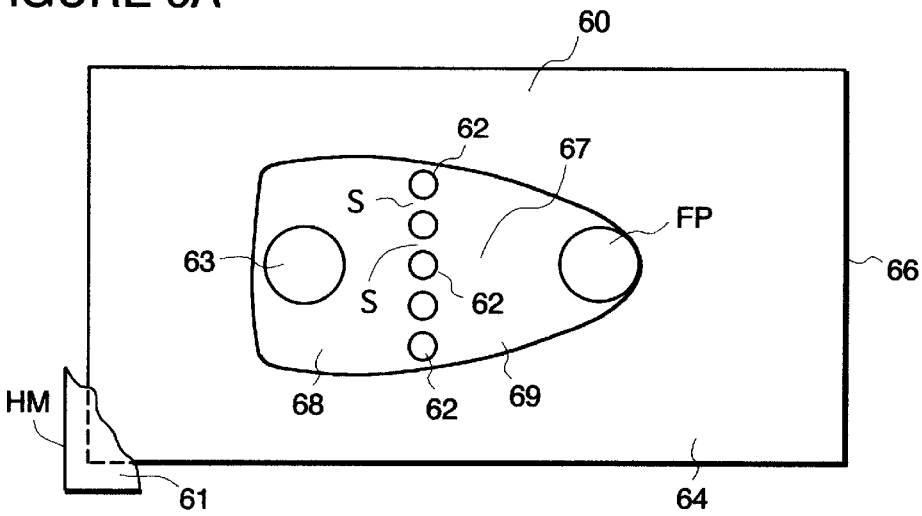
FIGS. 6C and 6D illustrate a further embodiment of a two-level device wherein the fluid oscillator is of the multiple power nozzle type.
Figure 6B:
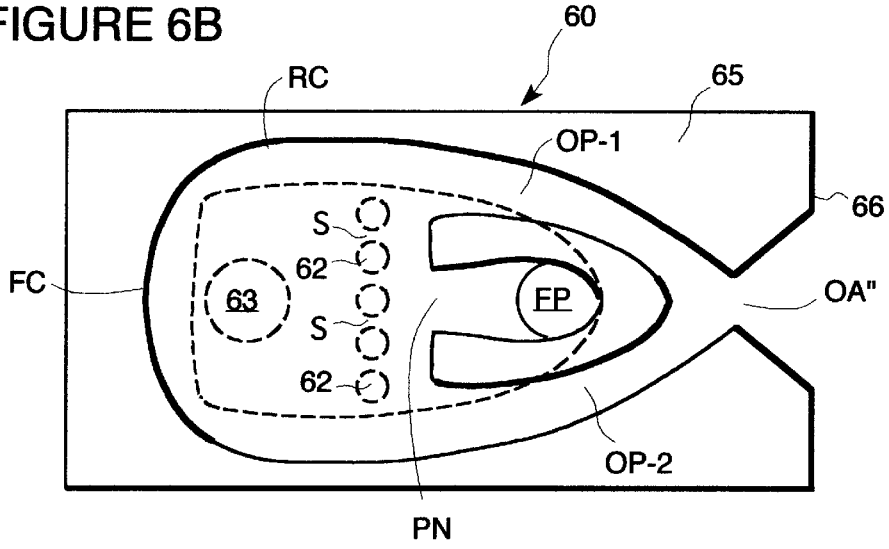

In the embodiment shown in FIGS. 6A and 6B, the fluid oscillator is of the reversing chamber type as disclosed in Raghu patent application Ser. No. 09/427,985, filed Oct. 27, 1999 entitled REVERSING CHAMBER OSCILLATOR.

Figure 1:
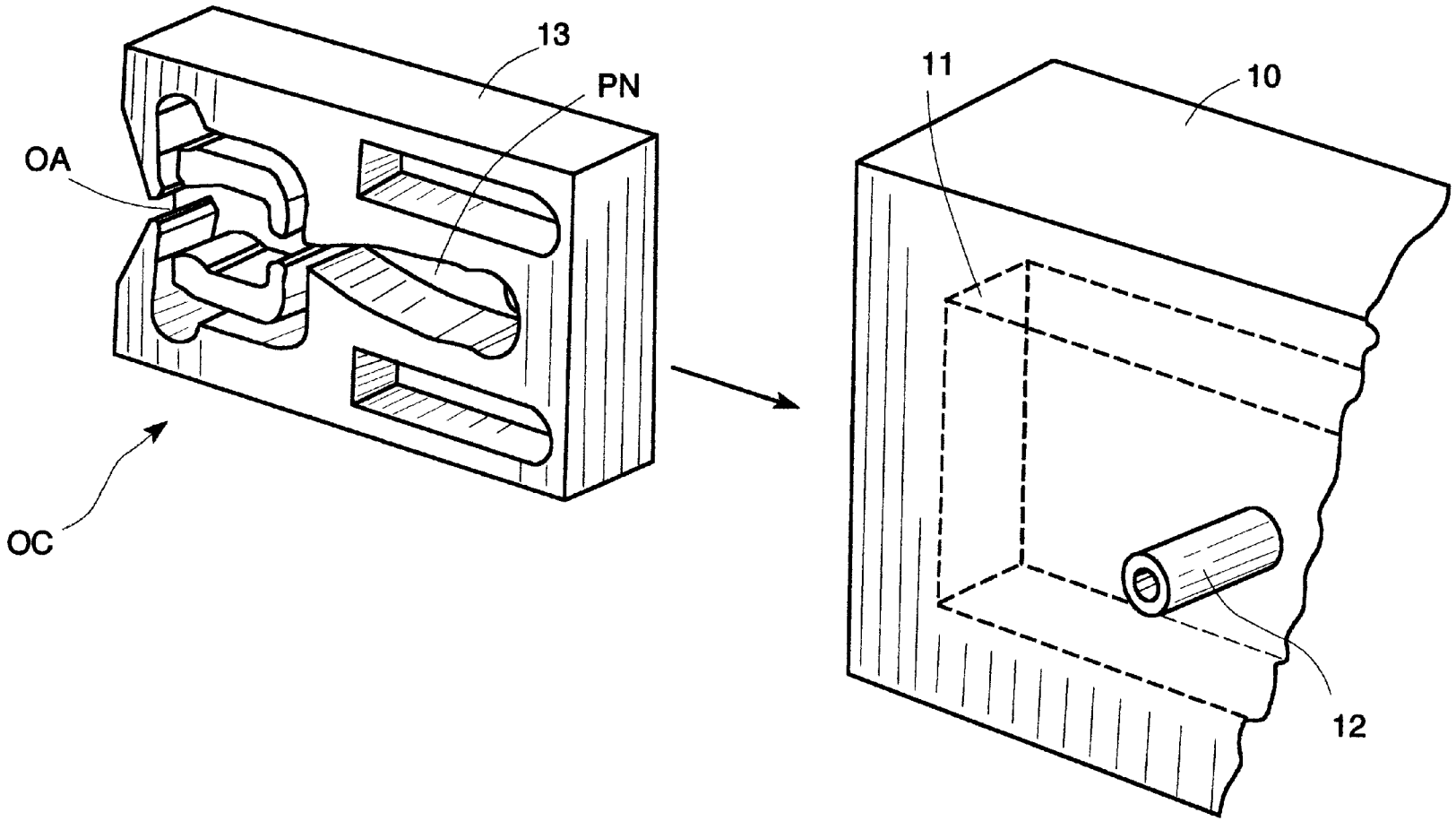
FIGURE 1 (PRIOR ART)
FIG. 1 is a diagrammatic exploded illustration of a prior art fluid oscillator chip or insert and housing.

The liquid spray device comprises a fluid circuit chip 60, a housing member HM having a chamber 61 for sealingly receiving fluid circuit chip 60 and an input port 63 (similar to port 12 in FIG. 1) for coupling chamber 61 to a source of liquid under pressure. Chip 60 has first 64 and second 65 sides and an output end 66 which is transverse to the first 64 and second 65 sides. The first side 64 (FIG. 6A) includes a subchamber 67 having upstream and downstream ends 68, 69 and a series of spaced posts 62 forming a filter dividing the upstream end of the subchamber 67 from the downstream end of the subchamber with said upstream end 68 being in registry with the input port 63 to receive liquid from the source of liquid under pressure. The second side (FIG. 6B) includes a reversing chamber fluid circuit FC formed therein. The fluid circuit FC has a power nozzle PN and a reversing chamber RC, there being a liquid flow path FP from the downstream end 69 of the subchamber 67 to the power nozzle PN, the fluid circuit FC in this embodiment has a pair of passages OP-1 and OP-2 which smoothly lead directly to an outlet throat OA' and an outlet to ambient in the output end as more fully described in Raghu application Ser. No. 09/427,985 filed Oct. 27, 1999.

Figure 6C:
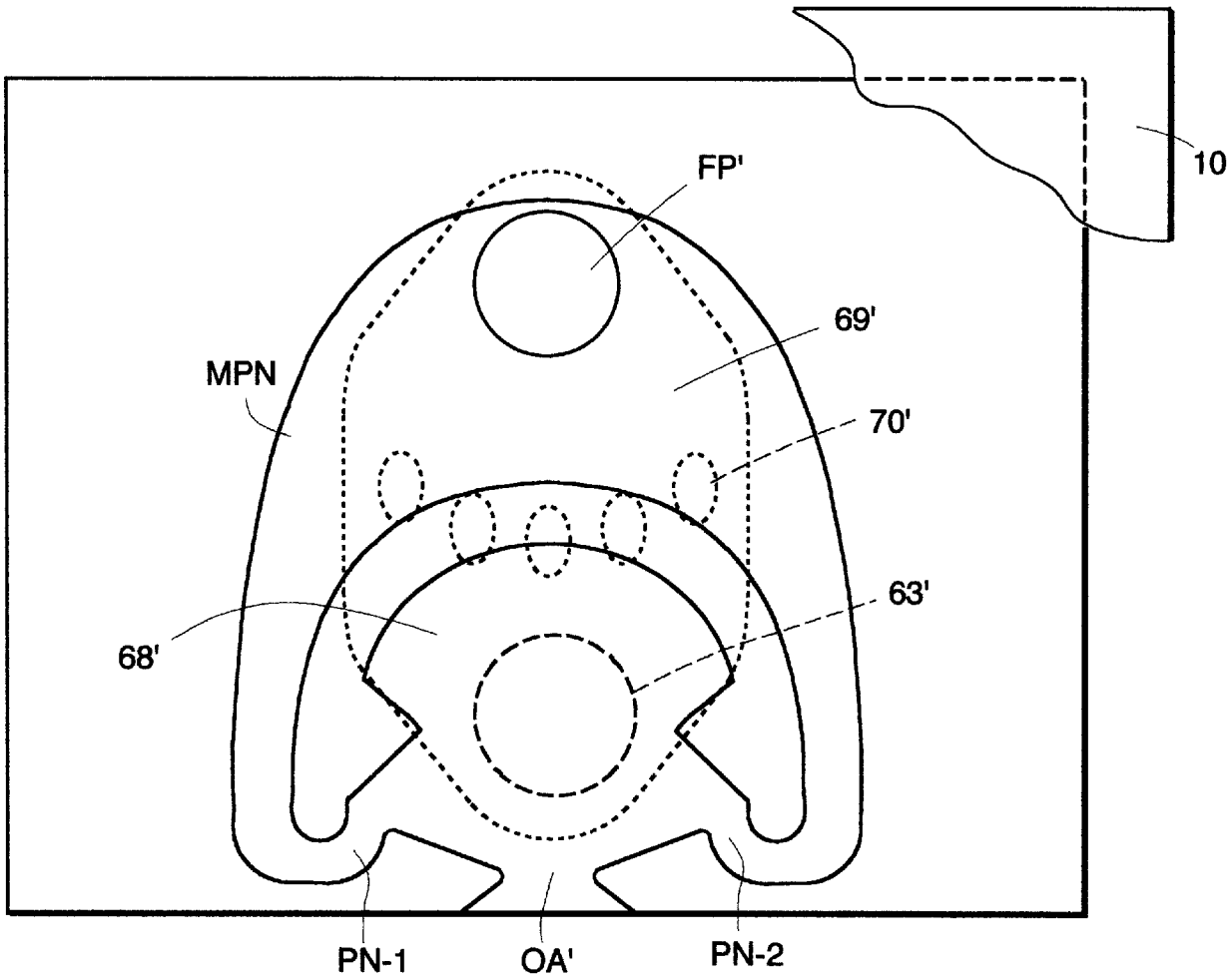
Figure 6D:
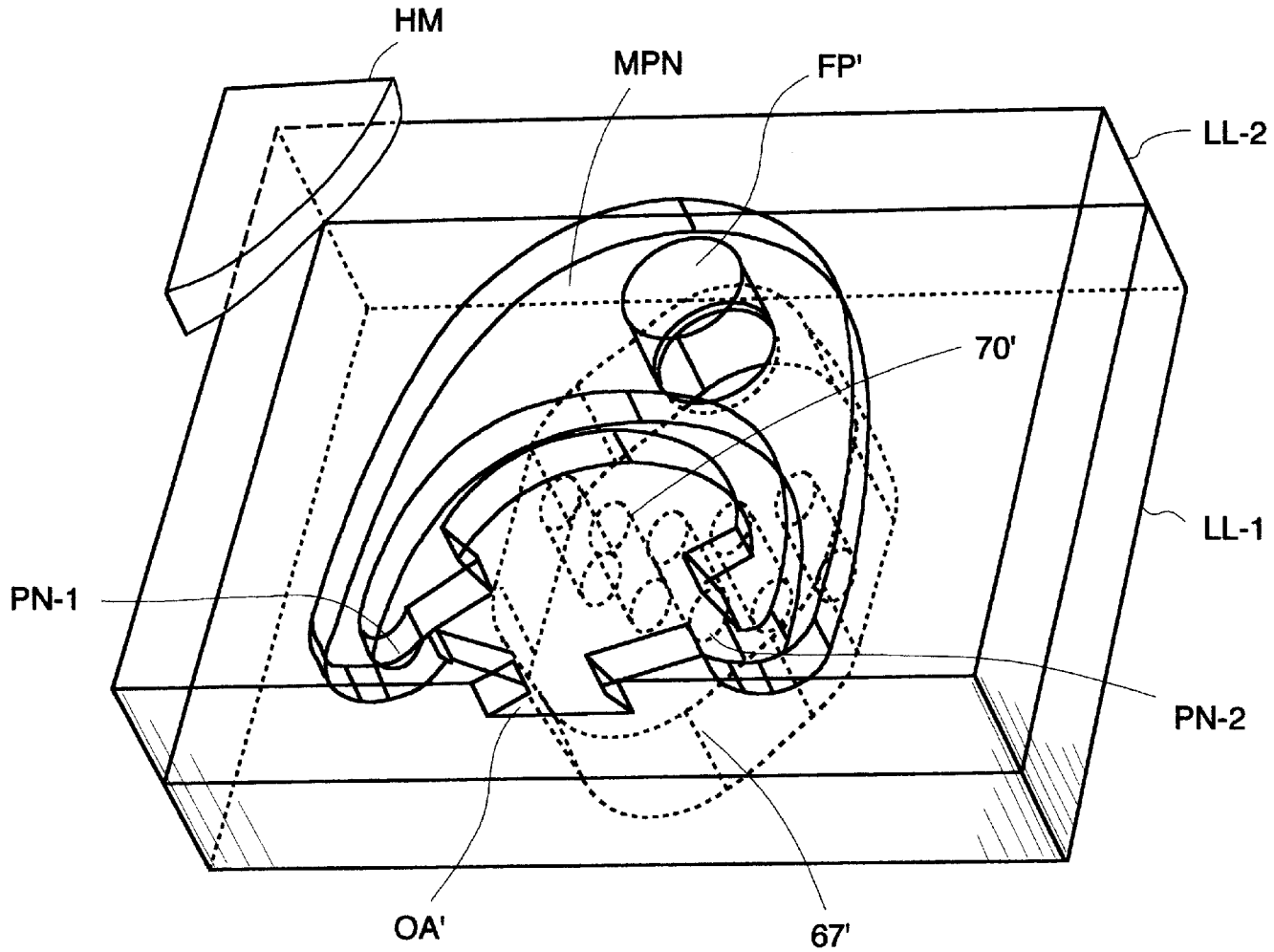

In the embodiment shown in FIGS. 6C and 6D, the multiple power nozzle type fluid oscillator as disclosed in Raghu patent application Ser. No. 09/417,899 entitled FEEDBACK-FREE FLUID OSCILLATOR AND METHOD is utilized. In FIGS. 6C and 6D, the lower level LL1 has formed in a surface thereof the infeed chamber shown in dotted lines and the filter posts 70' likewise shown in dotted lines. The infeed chamber 67' has an upstream end 68' and a downstream end 69' and a series of spaced posts 70' forming a filter dividing the upstream end 68' of the chamber 67' from the downstream end 69' of the chamber 67'. The upstream end 68' is in registry with the input port 63' shown in FIG. 6C in large dashed lines to receive liquid from the liquid source. The second side LL2 includes a fluid circuit FC which in this case is a multiple power nozzle fluid oscillator. In this embodiment, the power nozzle P-61, P-62, are oriented away from the outlet aperture OA and due to their angular orientation relative to the outlet aperture OA' a much lower frequency of oscillation is induced in comparison to the multiple power nozzle oscillator shown in FIGS. 2A and 3A. A liquid flow path FP' couples the downstream end 69' of the subchamber to a power nozzle manifeed manifold MPN.

It will be appreciated that numerous types of fluid circuits, including the fluid oscillator silhouettes of the types shown in FIGS. 2A, 3A, 4 and 5 may likewise be formed double-sided or in two levels with the filter chamber on one side and the fluid oscillator silhouette on the opposite side.

Figure 7:
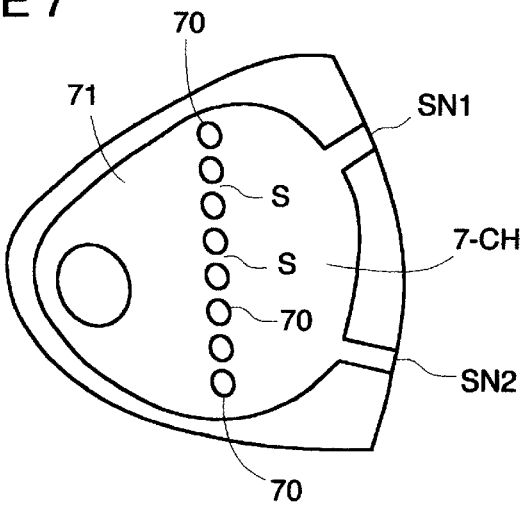
FIG. 7 is an illustration of a built-in filter according to the present invention in which the filter could be used in typical nonfluidic dual-jet-type windshield washer nozzle; the same use can be made for single and triple port nozzles of the same variety.

In the embodiment shown in FIG. 7, the integrated filter of this invention is shown as used in a typical nonfluidic dual type windshield washer nozzle. The same use can be made for a single and triple port nozzles of the same variety. In this case, the posts or pillars 70 in passage enlargement 71 are all in advance of the dual spraying nozzles SN-1, SN-2. This embodiment can also be made bilevel with the passage enlargement 71 and filter posts 70 formed in one surface of the molded chip and chamber 7-CH outputs SN-1, SN-2 formed on the opposing surface.

While the invention has been described in relation to preferred embodiments of the invention, it will be appreciated that other embodiments, adaptations and modifications of the invention will be apparent to those skilled in the art.

What is claimed is:

1. A liquid spray device comprising:

a fluid chip, a housing member having a chamber for sealingly receiving said fluid circuit chip and an input port for coupling said chamber to a source of liquid under pressure, said chip having a first and second sides and an output end which is transverse to said first and second sides, said first side including a subchamber having upstream and downstream ends and a series of spaced posts forming a filter dividing the upstream end of said subchamber from the downstream end of said subchamber with said upstream end being in registry with said input port to receive liquid from said source of liquid, said second side including a fluid circuit formed therein, said fluid circuit having a power nozzle, said fluid circuit having an outlet throat and an outlet to ambient in said output end for spraying said liquid to ambient, and a liquid flow path from said downstream end of said subchamber to said power nozzle.

2. The liquid spray device defined in claim 1 wherein said fluid circuit is a fluid oscillator.

3. The liquid spray device defined in claim 2, said fluid oscillator selected from reversing chamber or multiple power nozzle types.

4. A two-level liquid spray device comprising an input port, a fluid oscillator circuit chip having first and second sides and an output end which is transverse- to said first and second sides and a plane between said sides, said first side including a subchamber having an upstream and a downstream end and a series of spaced posts forming a filter dividing the upstream end of said subchamber from the downstream end of said subchamber with said upstream end being in registry with said input port to receive liquid from a source of liquid, said second side of said fluid oscillator circuit having a power nozzle and a liquid flow path from said downstream end of said subchamber and transverse to said plane and in registry with said power nozzle, said fluid oscillator circuit having an outlet throat and an outlet to ambient in said output end to spray said liquid to ambient, and means including said input port for enclosing said oscillator circuit chip.

5. A liquid spray device defined in claim 4 wherein said fluid oscillator is selected from a reversing chamber oscillator or a multiple power nozzle-type oscillator or a feedback-type oscillator.

* * * * *